US005597230A

United States Patent [19]

Newman

[11] Patent Number: 5,597,230

[45] Date of Patent: Jan. 28, 1997

[54] ORNAMENTAL CARRIER WITH FLASHLIGHT-TYPE EYES

[76] Inventor: Alfred T. Newman, 229 Marine Ave., Suite E, Balboa Island, Calif. 92662

[21] Appl. No.: 577,142

[22] Filed: Dec. 22, 1995

[51] Int. Cl.[6] ..... F21V 33/00

[52] U.S. Cl. ..... 362/154; 362/184; 362/234; 362/808

[58] Field of Search ..... 362/124, 154, 362/156, 184, 234, 237, 240, 241, 245, 808, 190, 191

[56] References Cited

U.S. PATENT DOCUMENTS

| | | | |
|---|---|---|---|
| 1,877,940 | 9/1932 | Morgenstern et al. | 362/124 |
| 2,457,019 | 12/1948 | Weber | 362/241 |
| 2,566,280 | 8/1951 | Yandt | 362/184 |
| 2,980,889 | 4/1961 | Meissner | 362/184 |
| 3,809,321 | 5/1974 | Rundberg | 362/184 |
| 4,149,224 | 4/1979 | King et al. | 362/157 |
| 4,802,071 | 1/1989 | Schuster | 362/154 |
| 4,926,296 | 5/1990 | Blume et al. | 362/156 |
| 4,955,807 | 9/1990 | Chance et al. | 431/296 |
| 5,016,145 | 5/1991 | Singleton | 362/80.1 |
| 5,091,833 | 2/1992 | Paniaguas et al. | 362/191 |
| 5,264,996 | 11/1993 | Bele, Jr. et al. | 362/162 |
| 5,359,506 | 10/1994 | Koleno | 362/248 |
| 5,422,799 | 6/1995 | Morrison, Sr. | 362/208 |

FOREIGN PATENT DOCUMENTS

| | | | |
|---|---|---|---|
| 585627 | 11/1958 | Italy | 362/184 |

*Primary Examiner*—Alan Cariaso
*Attorney, Agent, or Firm*—James G. O'Neill

[57] ABSTRACT

A hollow carrier in the shape of any object, such as a jack-o'-lantern, a skull or the like, is provided with a handle, a pair of eye openings in a face, and separate lights behind each of the eye openings, which lights, when activated by a switch connected between the separate lights and a power source, shine separate beams of light from each of the eye openings.

17 Claims, 1 Drawing Sheet

ORNAMENTAL CARRIER WITH FLASHLIGHT-TYPE EYES

BACKGROUND OF THE INVENTION

1. Field of the Invention

This invention relates generally to containers, and, more particularly, to an improved carrier for use by children or the like to carry items, and which carrier includes flashlight-type eyes.

2. Description of Related Art

There are many known prior art containers used by children and others to collect and carry items at certain times of the year, or at special functions. In particular, children carry baskets at Easter, or bags, jack-o'-lanterns or similar containers at Halloween, as well as at birthday parties, Christmas and similar events to hold candy, gifts, or treats.

For example, as Halloween has become more and more popular, children or adults go "trick or treating" carrying some type of a container, and in many cases, also carrying flashlights or similar devices to aid them in seeing and being seen. However, for many reasons, the carrying of a separate flashlight by a child has not proven successful. Therefore, attempts have been made to facilitate the child's carrying or wearing some type of lighting or safety means. One such known carrier is disclosed in U.S. Pat. No. 4,802,071 to Schuster, which shows a battery powered lantern in the shape of a jack-o'-lantern, used by a child to collect Halloween treats, and which has a single illuminating means inside, to light the lantern internally.

Another prior art device is shown in U.S. Pat. No. 4,926,296 to Blume et al, which discloses an illuminated flexible bag for transporting articles by an individual. The bag includes a power source which energizes a number of light bulbs which are mounted adjacent to transparent portions of the bag, and light from the light bulbs shines through the transparent portion for safety and decorative purposes. However, the light is not directed through the transparent portions.

Other typical prior art carriers, flashlights and lighting means are set forth in the following listed U.S. Patents:

| |
|---|
| 4,149,224 to King et al |
| 4,955,807 to Chance et al |
| 5,016,145 to Singleton |
| 5,091,833 to Paniaguas et al |
| 5,264,996 to Bele, Jr. et al |
| 5,359,506 to Koleno |
| 5,422,799 to Morrison, Sr. |

Although these prior art carriers and lighting means provide children and others with some safety at night, they do not meet today's ever increasing safety requirements of parents for their children, nor are they useful in substantially all situations by most children. Therefore, there still exists the need in the art for a simple to manufacture and use carrier having directed lighting means therein, which may be safely used by substantially any child, at any festive occasion, and which offers both increased safety and enjoyment for the child.

SUMMARY OF THE INVENTION

Accordingly, it is a general object of the present invention to provide an improved carrier. It is a particular object of the present invention to provide an improved carrier having flashlight-type eyes. It is a still more particular object of the present invention to provide an improved carrier having flashlight-type eyes and an easily operated control means thereon. It is yet a more particular object of the present invention to provide an improved carrier in the shape of a hollow head with eye openings therein, with lighting means behind and aimed therethrough to enable a child using the same to aim or direct multiple flashlight beams, for added enjoyment, as well as safety.

In accordance with one aspect of the present invention, there is provided a hollow carrier in any desired shape for carrying treats. The carrier is provided with a handle, a face having eye openings and bulbs behind the eye openings. The light from the bulbs is directed by lens and reflector means to provide beams of light through the eye openings. A switching means is provided between batteries and the bulbs for easily activating the flashlight-type eyes of the carrier to enable a person transporting the carrier to aim beams of light therefrom.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for a novel and improved carrying means.

Figure 1:
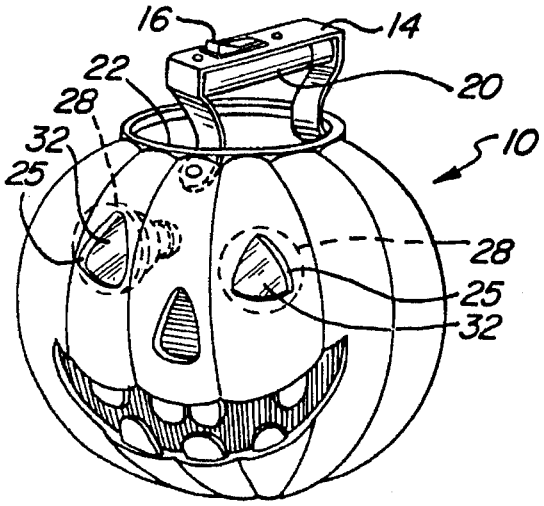
FIG. 1 is a perspective view of a jack-o'-lantern-type carrier of the present invention.
Figure 3:
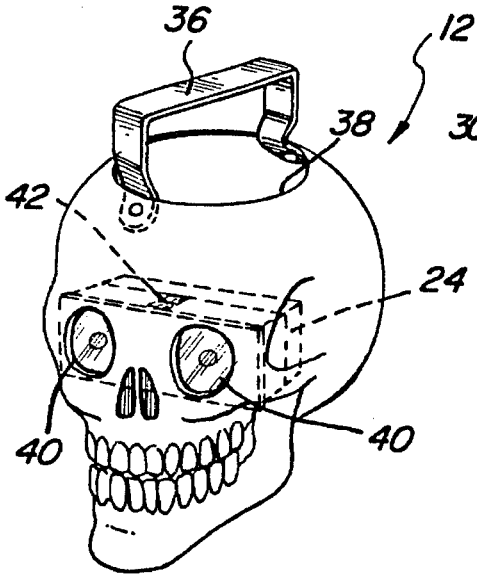
FIG. 3 is a further perspective view of a further embodiment of the carrier of the present invention, in the shape of a skull.

Although it is to be understood that the carrying means may be of any desired shade, and be made from any nontoxic material suitable for use by children, the carriers are preferably hollow bodies made from a highstrength plastic material, of any desired colors, and formed so as to have the hollow body in any desired shape, such as a jack-o'-lantern 10, shown in FIG. 1, or a skull 12, shown in FIG. 3. For illustrative purposes only, and not by way of limitation, the carrier or jack-o'-lantern 10 of the present invention is shown as having a handle 14 secured thereto, which handle has a switch 16 on the top thereof. Power means, such as a pair of batteries 18, may be provided in a tube or holding means 20 in the handle 14, or may be placed elsewhere, for example, inside the hollow interior 22 of the jack-o'-lantern. Or, the batteries 18 may be placed in a holder at the bottom of the hollow interior 22, or in a further light unit, such as 24 mounted in the interior of a carrier, as described more fully below.

Figure 2:
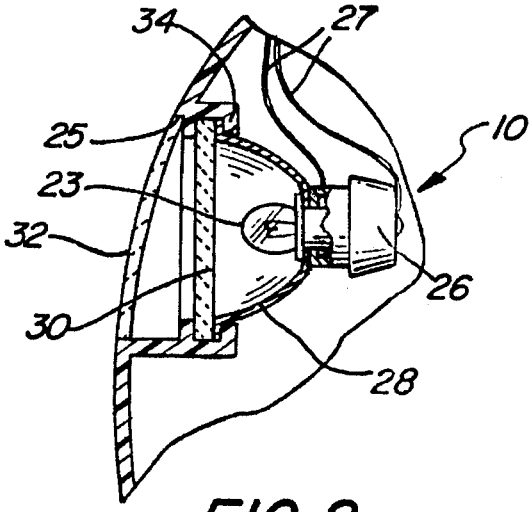
FIG. 2 is an enlarged, partial sectional view of one of the flashlight-type eyes of FIG. 1.

The switch 16 is electrically connected between the batteries 18 and bulbs 23, in a manner known to those skilled in the art. The bulbs 23 (see FIG. 2), are mounted behind eye openings 25 so as to directly cast a beam of light, or shine therethrough. The eye openings 25 may be of any desired shape, such as the triangular jack-o'-lantern eye openings shown in FIG. 1. The bulbs 23 are mounted behind the eye openings 25 as shown in FIG. 2, and in broken line in FIG. 1. That is, each of the bulbs is held in position behind an eye opening 25, in a socket 26, electrically connected between the switch 14 and the power source, as by wires 27. The socket 26 is centrally located within a reflector 28, of the type commonly used in a flashlight, to direct the light from each bulb 23, through a lens 30 and through a clear plastic cover, or further lens 32, held in each eye opening 25. The reflector 28 and lens 30 are preferably, removably held in holding means 34, integrally formed in the interior 22 of body 10 in such a manner, that substantially all the light from each bulb 23 passes through each eye openings 25 in a directed or narrow beam.

Figure 4:
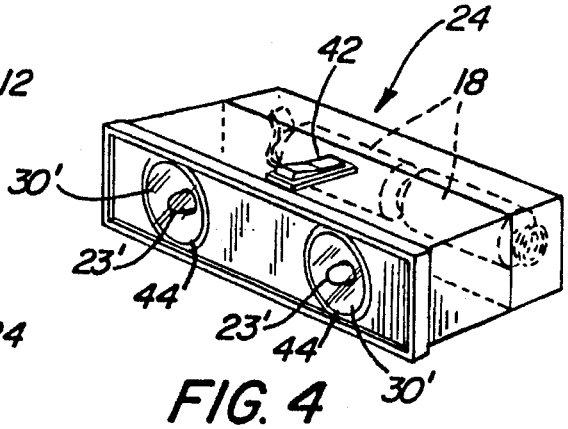
FIG. 4 is a still further perspective view of an alternate light source for the carriers of the present invention.
Figure 5:
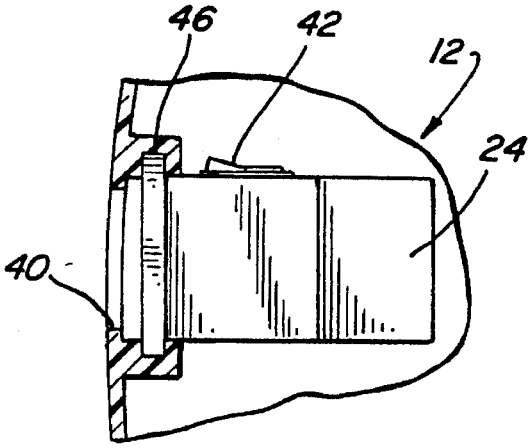
FIG. 5 is an enlarged partial sectional view of the skull of FIG. 3, having the light source of FIG. 4 therein.

Turning now to FIG. 3, there shown is a further embodiment of a carrier 12, in the shape of a hollow skull. The carrier 12 includes a carrying handle 36, secured to the hollow interior thereof in any convenient manner, through a top opening 38. The carrier 12 includes eye openings 40, behind which are mounted and held light means, such as shown in FIGS. 1 and 2, or the light unit 24 shown in FIG. 4. The light unit 24 contains a switch 42 on the top surface thereof that may be easily actuated by a person holding the skull 12, through opening 38. The light unit 24 also has two (2) separate eye lights 44, each of which has a lens 30' and a bulb 23'. The bulbs 23' are mounted in sockets similar to 26, and contain reflectors similar to 28 to direct the light from the bulbs 23' through the lenses 30'. The light unit 24 is sized and dimensioned so that the distance between the two eye light 44 is identical to the space between the eye openings 40 to enable the beams of light generated thereby to shine through the eye openings. Additionally, the space between the eye openings 40 is preferably substantially flat, to enable the light unit 24 to be inserted into and removed from a holding means 46 formed integrally in the hollow interior of skull 12, behind both eye openings 40. If desired, the eye openings 40 may also contain a clear plastic cover or lens therein, similar to the clear covers 32, shown in FIGS. 1 and 2, except such clear covers would be shaped to fit into the eye openings 40.

The holding means 34 and holding means 46 may be formed from a resilient material and separately secured within the hollow interiors of the carriers 10 and 12, respectively, to facilitate the insertion, removal and holding of the separate reflectors 28 and lenses 30 therein.

In use, the carriers 10 and 12 are easily held and carried by a child or other person. The openings in the tops thereof are sufficiently large to enable the lighting means, treats, etc. to be easily inserted and removed. Furthermore, the switch means 16 and 42 are in positions where they may be easily activated by a child, so that the child may shine the "flashlight-type beams" through the eyes thereof into a darkened area or onto a sidewalk or the like, for both enjoyment and safety purposes. The multiple beams of light coming from the respective eye openings 25 or 40 may be aimed or directed by the child carrying the carrier 10 or 12, by merely moving the carrier in the desired direction and/or motion.

It, therefore, can be seen that the hollow carriers 10 and 12, having a lighting means secured in the interior thereof, behind eye openings, enables a child to maneuver the carrier to shine beams of light from the eyes thereof. This combination of any shaped carrier with flashlight-type eyes provides additional enjoyment and safety for a child, whether at night or in a darkened room, for both the amusement of the child and to aid in locating or seeing the child.

It, thus, can be seen that the carriers and flashlight eyes of the present invention provide an improved means for use by children to enhance their enjoyment, and improve their safety.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed:

1. A hollow carrier for carrying treats comprising, in combination:

a shaped body having an opening formed through a top portion thereof through which said treats are freely inserted into and removed from a hollow interior;

a pair of eye openings formed in said shaped body within a face formed on said shaped body;

a handle means for carrying said body secured within said opening at the top portion of said body;

a plurality of light means secured within said hollow interior of said shaded body aligned with said eye openings; each of said plurality of light means comprising a socket, a bulb, a reflector and a lens;

holding means within said hollow interior of said shaped body behind said eye openings for removably capturing said light means therein so that each of said plurality of light means are aligned with said eye openings; and switch means connected to a power source for actuating said bulbs in said carrier so as to shine beams of light through said eye openings.

2. The carrier of claim 1 wherein said hollow body is in the shape of a jack-o'-lantern, and said eye openings are substantially triangular in shape.

3. The carrier of claim 2 wherein there are two separate light means held in separate holding means formed behind each of said eye openings.

4. The carrier of claim 3 wherein said switch is mounted in a top of said handle means.

5. The carrier of claim 4, further including a battery holding means mounted in said handle means including a plurality of batteries therein electrically connected between said switch and said two separate light means.

6. The carrier of claim 2 wherein said plurality of light means is a single light unit having two separate lighting means therein, and said switch means is formed in said single light unit and electrically connected between said two separate lighting means and said power source.

7. The carrier of claim 6 wherein said single light unit is mounted in the hollow interior behind said eye openings, with each of said separate lighting means in said single light unit aligned with, and shining through, said eye openings.

8. The carrier of claim 1 wherein said carrier is in the shape of a hollow skull having substantially circular eye openings therein.

9. The carrier of claim 8 wherein there are two separate light means held in separate holding means formed behind each of said eye openings.

10. The carrier of claim 9 wherein said switch is mounted in a top of said handle means.

11. The carrier of claim 8 wherein said plurality of light means is a single light unit having two separate lighting means therein, and said switch means is formed in said single light unit and electrically connected between said two separate lighting means and said power source.

12. The carrier of claim 11 wherein said single light unit is mounted in the hollow interior behind said eye openings with each of said separate lighting means in said single light unit aligned with, and shining through, said eye openings.

13. A hollow carrier for carrying treats comprising, in combination:

a body in the shape of a jack-o'-lantern having a hollow interior;

a pair of substantially triangular shaped eye openings formed in said body within a jack-o'-lantern face formed thereon;

a handle means having a switch means therein secured within an opening at the top of said body;

a plurality of separate light means secured within said hollow interior of said body behind each of said substantially triangular shaped eye openings; each of said plurality of separate light means comprising a socket, a bulb, a reflector and a lens;

holding means within said hollow body behind said substantially triangular shaped eye openings for removably capturing one of said plurality of separate light means therein so that said one of said plurality of light means are aligned with one of said eye openings; and said switch means being connected to a power source for actuating said bulbs so as to shine separate beams of light through each of said substantially triangular shaped eye openings.

14. The carrier of claim 13, further including a battery holding means mounted in said handle means, said battery holding means including a plurality of batteries therein electrically connected between said switch means and said plurality of separate light means.

15. A hollow carrier for carrying treats comprising, in combination:

a body in the shape of a skull having a hollow interior;

a pair of substantially circular eye openings formed in said body within a skull face formed thereon;

a handle means for carrying said body secured within an opening at the top of said body;

a plurality of separate light means secured within said hollow interior of said body behind each of said substantially circular eye openings; each of said plurality of light means comprising a socket, a bulb, a reflector and a lens;

holding means within said hollow body behind said substantially circular eye openings for removably capturing said plurality of separate light means therein so that each of said plurality of light means are aligned with said eye openings; and switch means connected to a power source for actuating said bulbs in said carrier so as to shine separate beams of light through each of said substantially circular eye openings.

16. The carrier of claim 15 wherein said plurality of light means are held in a single light unit; said single light unit having two separate lighting means therein, said switch means is formed in said single light unit, and said switch means is electrically connected between said two separate lighting means and said power source.

17. The carrier of claim 16 wherein said single light unit is mounted in the hollow interior of said carrier behind said substantially circular eye openings, with each of said two separate lighting means in said single light unit aligned with, and separately shining through one of said substantially circular eye openings.

* * * * *